United States Patent [19]

Rossi

[11] 4,036,281

[45] July 19, 1977

[54] METHOD FOR CONTINUOUSLY CASTING A SLAB

[76] Inventor: Irving Rossi, Dunros Farm, James St., Morristown, N.J. 07960

[21] Appl. No.: 619,464

[22] Filed: Oct. 3, 1975

[51] Int. Cl.[2] ..... B22D 11/124

[52] U.S. Cl. ..... 164/89; 164/283 S

[58] Field of Search ..... 164/282, 82, 283 R, 164/283 S, 283 M, 283 MS, 83, 89; 134/64 R, 64 P, 122 R, 122 P, 9, 15

[56] References Cited

U.S. PATENT DOCUMENTS

| | | | |
|---|---|---|---|
| 2,770,021 | 11/1956 | Harter | 164/89 |
| 2,789,328 | 4/1957 | Ackerman | 164/283 MS |
| 3,468,362 | 9/1969 | Burkhardt | 164/89 |
| 3,499,456 | 3/1970 | Rerecich | 164/89 X |
| 3,709,648 | 1/1973 | Kuhnlein | 164/82 X |
| 3,753,793 | 8/1973 | Wagener | 164/89 X |
| 3,765,472 | 10/1973 | Rossi | 164/283 X |
| 3,918,514 | 11/1975 | Schoffmann | 164/282 X |
| 3,931,848 | 1/1976 | Schmid | 164/83 |

FOREIGN PATENT DOCUMENTS

| | | | |
|---|---|---|---|
| 2,401,263 | 11/1974 | Germany | 164/283 S |

*Primary Examiner*—Francis S. Husar
*Assistant Examiner*—John S. Brown
*Attorney, Agent, or Firm*—Hopgood, Calimafde, Kalil

[57] ABSTRACT

In the continuous casting of very wide steel slabs, the use of the conventional transverse rollers to support the wide side walls of the slab to prevent bulging or deflection thereof due to the ferrostatic pressure applied thereto by the molten core or due to other stresses is avoided by applying intensive cooling to the surfaces of the narrow end walls of the slab and to the surfaces of the immediately adjoining wide side walls to increase the wall thickness of said end walls and of the immediately adjoining wide side walls more rapidly than the thickness of the portions of the wide side walls extending laterally therefrom is increased whereby the thickened end walls and immediately adjoining thickened portions of the wide side walls act as the ends of constrained beams to support and resist deflection of the remaining portions of the wide side walls.

3 Claims, 4 Drawing Figures

FIG.1
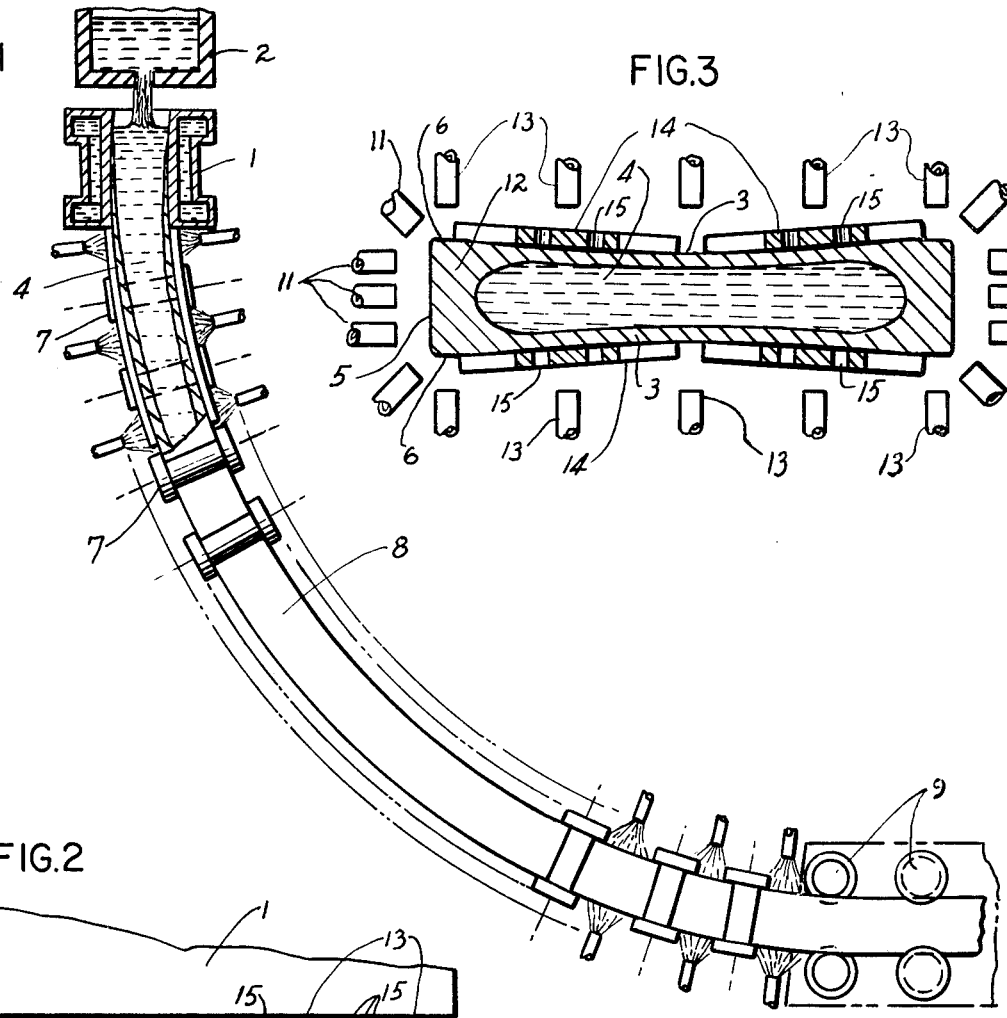
FIG.3
FIG.2
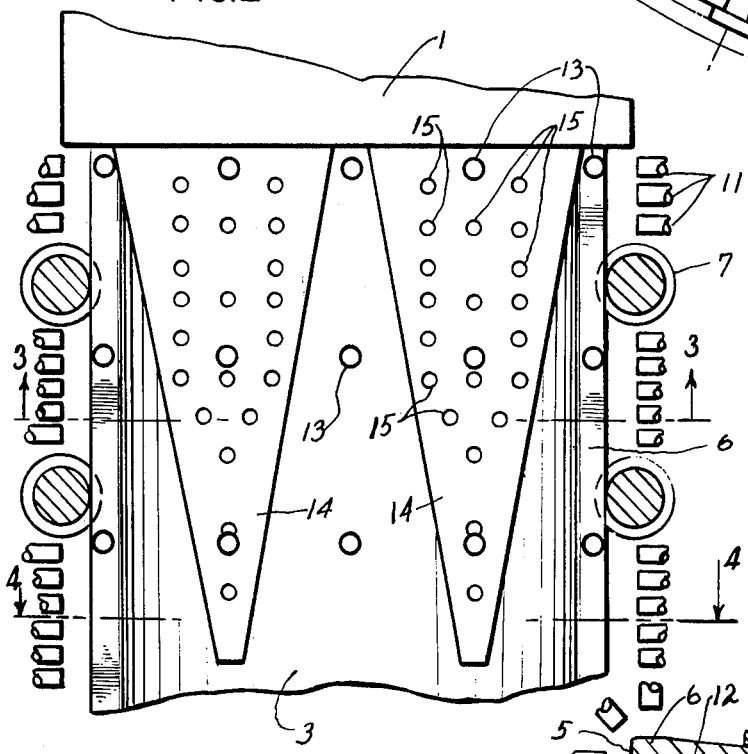
FIG.4
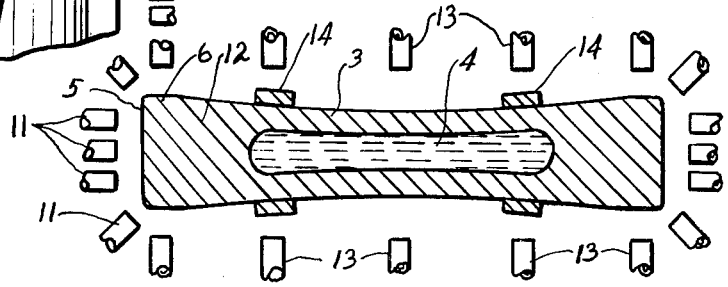

METHOD FOR CONTINUOUSLY CASTING A SLAB

This invention relates to the continuous casting of a steel strand in the form of a rectangular slab having opposed wide side walls and opposed narrow end walls joining side wide side walls.

In the steel industry, in the use of continuous casting, the recent trend of thinking has been in the direction of casting wider and wider slabs, which, after solidification may be slit longitudinally to provide narrower slabs or shapes for subsequent processing such as rolling, for example. Up to the present time, because of the complicated equipment required, it has not appeared practical to cast slabs having a width in excess of 80 inches, but it has been receognized that important advantages could be realized if it became possible to cast even wider slabs having a width of 100 inches or more. For example, a slab having a width of 120 inches could be slit longitudinally to provide slabs of various widths totalling 120 inches. This would be far more economical than casting individual slabs of such widths, and would avoid the need for frequent mold changes to cast individual slabs of the desired widths and would thereby increase the capacity of the machine. It would also avoid the need to use multiple strand continuous casting machines which are costly and difficult to operate.

However, it has also been receognized that serious mechanical and economic problems are involved in the construction and operation of continuous casting machines capable of casting slabs even of a width of 80 inches and these problems are magnified in the case of machines capable of casting slabs wider than this. One of the most serious problems has to do with the so-called "roller aprons" now conventionally used in the secondary cooling zone of continuous casting machines to support the walls of the casting below the mold to prevent bulging or deflection of the walls and possible rupture and spills of molten metal due to the ferrostatic pressure applied to the walls by the molten metal core. The disclosures of U.S. Pat. Nos. 3,752,210, 3,763,923 and 3,831,661 illustrate and describe some of the complexities and problems of such roller aprons or roll racks as they are sometimes referred to.

This problem is particularly serious in the case of slab casting, and increases as the width of the slab is increased. That is, as the width of the slab is increased, the diameter of the rollers must be increased in order to provide the necessary strength and rigidity to resist bending. This requires the use of larger and stronger hydraulic supports, load cells and bearings for the rollers, all of which vastly increases the cost of the machines and the maintenance thereof. in addition, even these rolls are subject to breakage due to the heat and pressure to which they are subjected, and the wider the slab the greater the pressures applied thereto. More importantly, the use of the larger diameter rollers increases the difficulty of applying cooling water to the strand as it moves through the secondary cooling zone. That is, the cooling water is applied to the surfaces of the wide sides of the slab through the spaces between adjacent successive rollers. Therefore, as the diameter of the rollers in increased, the distance between the axes of rotation of successive rollers must be increased, with the result that the distance between successive applications of cooling water is also increased. Even in existing machines, such rollers sometimes occupy up to 80% of the surfaces of the wide sides of the slab.

In my prior U.S. Pats. Nos. 3,766,962 and 3,765,472, I have dealt with this problem by casting a slab in which the oppositely disposed wide side walls thereof are concavely arched in order to resist outward bulging or deflection caused by the ferrostatic pressure applied thereto by the molten metal core. In U.S. Pat. No. 3,766,962, the concavely arched walls are maintained within the secondary cooling zone by the compressive stresses applied to the narrow end walls of the slab in a direction transverse of the slab. In U.S. Pat. No. 3,765,472, the concavely arched walls are maintained within the secondary cooling zone by the application of intensive cooling to the concavely arched surfaces of the wide side walls to establish thermal stresses within the side walls which resist bulging or deflection caused by ferrostatic pressure.

In both cases, the described methods permit the elimination of the rollers, thus making possible the continuous, uninterrupted application of cooling water to the wide side surfaces of the strand longitudinally of the strand which promotes more rapid cooling and solidification and thereby makes it possible to greatly reduce the length of the machine and its cost.

It is an object of the present invention to provide another method of preventing bulging or deflection of the wide side walls of continuously cast slabs within the secondary cooling zone without the use of supporting rollers as in the conventional roller aprons.

According to the present invention, I propose to subject the surfaces of the narrow end walls and the surfaces of the wide side wallsimmediately adjoining them to very intensive cooling below the mold by applying coolant fluid directly onto said surfaces to rapidly build up solidified metal in said narrow end walls and in portions of said side walls immediately adjoining said end walls, while simultaneously subjecting the other surfaces of said wide side walls extending laterally therefrom to less intensive cooling by applying coolant fluid directly onto said surfaces, so that there is a differential in the intensity of the cooling applied to the reprective surfaces. The coolant applied to said narrow end surfaces and to said immediately adjoining wide side surfaces being applied at sufficiently high intensity to increase the wall thickness of said end walls and of the immediately adjoining wide side walls more rapidly than the thickness of those portions of said wide side walls extending laaterally therefrom is increased by the coolant applied thereto, whereby the thickened end walls and immediately adjoining thickened portions of said wide side walls act as the ends of constrained beams to support and resist deflection of the remaining portions of the wide side walls due to the ferrostatic pressure of said molten core or other causes. The coolant fluid is continuously applied to said narrow end and wide side surfaces extending longitudinally of said strand as above described from the level where the strand emerges from the mold to the level where the walls of said shell become self-sustaining. The method is particularly advantageous when use in connection with slabs as initially formed in the mold with concavely arched wide side walls, although it may also be used to advantage in connection with slabs initially formed with flat wide side walls.

According to the present invention, it is also proposed to provide machanical support for the wide side walls immediately below the mold by the provision of cooling plates or grids extending downwardly from the bottom of the mold along the wide sides thereof and having surfaces conforming to the contours of the slab surfaces to which they are opposed. The said plates or grids are porvided with passages or apertures through which cooling water may be applied to the opposed surfaces of the slab, and the areas of the plates or grids are preferably restricted to oppose those areas of the wide side wall of the slab within which bending stresses and the maximum deflection are most likely to occur. It is recognized that due to the action of the constrained beams as above described, the regions where the wide side walls are subjected to maximum bending stresses resulting from ferrostatic pressures applied thereto are those immediately adjoining the thickened portions created by application of intensive cooling, and that the maximum deflection resulting from any bending which may occur will be at the center of the walls immediately below the mold. It is also recognized that the danger of such bending and deflection recedes as the strand moves through the secondary cooling zone and the soldification of the walls proceeds and the width of the liquid crater narrows. Therefore, the plates or grids are preferably triangular in shape and are arranged in pairs with one pair opposed to each wide side wall. The bases of the triangles are located adjacent to the bottom of the mold with the apexes of the triangles pointing downwardly and extending at least to the level where the wall thickness of the solidified shell becomes slef-sustaining. The outside edges of the triangles are preferably tapered away from the edges of the slab walls which are already solidified as they no longer need support. The inside edges of the triangles preferably diverge away from the longitudinal center of the slab as the solidified shell thickens and it becomes more than strong enough to support the ferrostatic pressure.

It will be understood that the primary purpose of said plates or grids is precautionary and to provide safety against unexpected or excessive deflection of the side walls, particularly in the region close to the bottom of the mold, due to inadequate cooling of the end walls or due to changes in conditions such as changes in temperature of the metal flowing into the mold, changes in temperature or quantity of the cooling water, changes in rate of withdrawal and the like.

A semi-diagrammatic illustration of a preferred embodiment of apparatus in which the method of the invention may be practiced is shown in the accompanying drawings, in which:

FIG. 1 is a side elevation of the apparatus, partly broken away.

FIG. 2 is an enlarged front elevation of a portion of the apparatus adjacent the bottom of the mold.

FIG. 3 is a section on the line 3—3 of FIG. 2 showing the thickening of the narrow end walls of the casting.

FIG. 4 is a similar section on the line 4—4 of FIG. 2 showing the progressive thickening of the narrow end walls.

Referring to the drawings, the apparatus comprises a water cooled mold 1 into which molten steel is poured continuously from a tundish 2 of conventional construction. The mold 1 is also of conventional construction except that a major portion of the surfaces of each of the wide side walls of the mold passage is slightly convex in transverse cross sectional contour in order that the major portion of the surfaces of each of the wide side walls 3 of the casting will be slightly concave in transverse cross section as shown in FIG. 3. Thereby each of the wide side walls of the casting is in the form of an arch which tends to resist deflection due to ferrostatic pressure applied by the molten core 4. Preferably, the surfaces of the narrow end walls 5 of the casting are flat as shown in FIG. 3 and adjoining relatively narrow areas 6 of the surfaces of the wide side walls are flat. The said flat surfaces are adapted to be engaged by the short rollers 7 which support and guide the casting during its progress through the secondary cooling zone.

Preferably also, the mold passage through the mold within which the walls of the casting are formed initially is curved in accordance with the disclosure of Schneckenburger U.S. Pat. No. 2,947,075, so that the partially solidified strand 8 which emerges from the mold is curved longitudinally as shown in FIG. 1 for reasons described in said patent. It will be understood that the movement of the strand through the secondary cooling zone is controlled by conventional withdrawal rolls 9.

In order to apply very intensive cooling to the surfaces of the narrow end walls of the casting, and to the surfaces of the wide side walls immediately adjoining said end walls a series of clusters of closely spaced nozzles 11 are provided through which sprays of cooling water are discharged at high pressure. The said clusters extend from immediately below the mold at least to a point where the walls of the strand are sufficiently soldified to be self-supporting. The application of very intensive cooling to the surfaces of the narrow end walls of the casting and to the surfaces of the wide side walls immediately adjoining said end walls results in a rapid thickening of the end walls as indicated at 12 of FIG. 3. The progressively greater thickening of said walls as the strand moves through the secondary cooling zone is indicated in FIG. 4. This thickening enables the end walls and immediately adjoining portions of the side walls to act as the ends of constrained beams to support and resist deflection of the remaining portions of the wide side walls caused by the ferrostatic pressure of said molten core.

This resistance to deflection is aided by the simultaneous application of cooling to the remaining surfaces of the wide side walls, but such cooling is applied less intensively than that applied to the other surfaces as previously described. For this purpose, spray nozzles 13 are provided through which cooling water may be directed toward the said surfaces of the wide side walls.

Mechanical support for limited areas of the wide side walls of the strand are provided by supporting plates or grids extending downwardly from the mold. In the preferred embodiment illustrated, such mechanical support is provided by plates 14. The said plates are preferably triangular shaped and have surfaces conforming to the contours of the surfaces of the wide side walls to which they are opposed. That is, in transverse cross section, the plates are curved to conform to the curved arched contours of the wide side walls, and in longitudinal cross section, they are curved to conform to the longitudinal curvature of the strand. A pair of such plates is provided for each wide side wall, and each plate is provided with a multiplicity of apertures 15 through which cooling water may pass into the space between the surfaces of the plates and the surfaces of the casting to cool the casting and to provide lubrication between the surfaces. Alternatively, the plates may be hollow and provided with apertured walls opposed to the surfaces of the casting through which water may flow. Alternatively, also the mechanical supports may be in the form of grids comprising a plurality of longitudianlly extending bars of varying lengths each forming a triangular shaped assembly similar to the shape of the triangular plates 14.

The outside edges of the plates or grids are preferably tapered inwardly away from the edges of the wide side walls, and the inside edges of the plates or grids diverge from the center of the slab. Thus, the supporting members are designed to provide maximum support for the wide side walls of the casting along the regions where the bending stresses are at a maximum and where the maximum deflection is likely occur as hereinbefore explained. By so designing the supporting members, the friction between the strand and the supporting members is minimized, while at the same time the exposure of the surface of the casting to cooling is increased.

I claim:

1. The method of continously casting a steel strand in the form of a rectangular slab having opposed wide side walls and opposed narrow end walls joining said wide side walls which comprises pouring molten steel into the upper end of a chilled mold having a mold passage of substantially rectangular cross section, continuously withdrawing from said mold a partially solidified strand comprising relatively thin soldified side and end walls forming an outer shell surrounding an inner molten core, subjecting the surfaces of said narrow end walls and the surfaces of the wide side walls immediately adjoining them to very intensive cooling below said mold by applying coolant fluid directly onto said surfaces to rapidly build up soldified metal in said narrow end walls and in portions of said side walls immediately adjoining said end walls, simultaneously subjecting the other surfaces of said wide side walls extending laterally therefrom to less intensive cooling by applying coolant fluid directly onto said surfaces so that there is a differential in the intensity of the cooling applied to the respective surfaces, the coolant applied to said narrow end surfaces and to said immediately adjoining wide side surfaces being applied at sufficiently high intensity to increase the wall thickness of said end walls and of the immediately adjoining wide side walls more rapidly than the thickness of those portions of said wide side walls extending laterally therefrom is increased by the coolant applied thereto, whereby the thickened end walls and immediately adjoining thickened portions of said wide side walls act as the ends of constrained beams to support and resist deflection of remaining portions of the wide side walls caused by the ferrostatic pressure of said molten core, and continuously applying coolant fluid to said narrow end and wide side surfaces of such differential intensities along continuous areas of said surfaces extending longitudinally of said strand from the level where the strand emerges from the mold to the level where the walls of said shell become self-sustaining.

2. The method of claim 1 in which said wide side walls are cast in the form of curved arches extending transversely of the strand.

3. The method of claim 1 which includes applying mechanical support to each of the wide side walls of said strand below the mold along pairs of triangular shaped areas in which the outside borders of each area are spaced from the outside edges of said wide side walls and converge inwardly toward the longitudinal center of the strand and the inside borders of each area diverge outwardly from the center, said mechanical support being applied from the level where the strand emerges from the mold to the level whee the walls of said sheel become self-sustaining.

* * * * *